United States Patent [19]

McGhee et al.

[11] Patent Number: 4,700,886

[45] Date of Patent: Oct. 20, 1987

[54] INTEGRATED, USAGE-DEPENDENT TEMPERATURE CONTROL FOR GAS WATER HEATERS

[75] Inventors: James B. McGhee; Joseph W. Egan, both of El Cajon, Calif.; Leslie C. Hill, 6683 Caminito Hermitage, La Jolla, Calif. 92037

[73] Assignee: Leslie C. Hill, La Jolla, Calif.

[21] Appl. No.: 868,662

[22] Filed: May 29, 1986

Related U.S. Application Data

[63] Continuation of Ser. No. 698,612, Feb. 6, 1985, abandoned.

[51] Int. Cl.[4] ..... F22B 35/00; F24H 9/20

[52] U.S. Cl. ..... 236/25 R; 237/19

[58] Field of Search ..... 237/8 R, 19; 236/20 R, 236/46; 219/334, 330, 508

[56] References Cited

U.S. PATENT DOCUMENTS

| | | | |
|---|---|---|---|
| 4,016,402 | 4/1977 | Scott | 219/334 |
| 4,166,944 | 9/1979 | Scott | 219/330 |
| 4,336,902 | 6/1982 | Neal | 236/46 F |
| 4,371,779 | 2/1983 | Maynard et al. | 236/25 R |
| 4,413,775 | 11/1983 | Scott | 236/20 R |

*Primary Examiner*—Henry A. Bennet

*Attorney, Agent, or Firm*—Brown, Martin Haller & Meador

[57] ABSTRACT

The control utilizes sensed gas pressure downstream of the thermostat controlled valve as an indication of heat demand. A low limit transducer is placed at 50 to 90 percent of the tank height to maintain adequate heated water for casual uses without excessive burner cycling. A flow transducer is integrated with a heat trap. The control uses output of the flow transducer (combined with the timing out of an interval timer) to enable an excursion from the low limit set point to the thermostat high limit.

10 Claims, 5 Drawing Figures

INTEGRATED, USAGE-DEPENDENT TEMPERATURE CONTROL FOR GAS WATER HEATERS

This is a continuation of application Ser. No. 698,612 filed Feb. 6, 1985 now abandoned.

BACKGROUND OF THE INVENTION

The domestic hot water heater is one of the highest energy consumers in the typical home. Contrary to the situation elsewhere in the world, most hot water installations in the Unites States store a pre-heated supply of hot water. Therefore, substantial energy consumption continues even during periods of no hot water usage. The amount of energy loss is a function of the difference between the temperature maintained by the water heater and the ambient temperature. The higher the system temperature, the higher the losses due to convection and conduction.

Most uses for domestic hot water require the temperature delivered to the outlet to be 110 degrees or less. For example, for showering, a typical person takes a shower with water temperatures of 110 degrees or less. Therefore, the only function of water heater system temperatures above 110 degrees for that purpose is to build a temperature reserve. With higher tank temperatures the person will mix hot and cold water causing the effective system capacity to increase.

Systems according to the prior art have recognized that substantial energy conservation benefits can be obtained by a reduction in the water heater system temperature during periods of non-use, and increasing the system temperature only when substantial water flow indicates a substantial prospective demand for hot water; and therefore, for system temperatures which create an energy reserve. However, such systems require a mechanical attachment to, and manipulation of the standard water heater controls; and are therefore not well suited to, or modification of the standard water heater thermostat control, or cannot benefit from, the integration into the water heater design itself.

Accordingly, an integrated usage dependent controller for gas water heaters is desirable, particularly where such an integrated gas water heater usage dependent controller does not disturb normal system functions including main thermostat gas control and vacation settings.

SUMMARY OF THE INVENTION

In an exemplary embodiment, the integrated, usagedependent temperature control for gas water heaters, according to the invention, senses gas line pressure downstream of the main thermostat gas valve as an indication that the main thermostat is calling for increased tank temperatures. This parameter is integrated with signals representative of the tank temerature and water flow to determine if the usage dependent system should withhold gas flow, despite the call for heat from the main system thermostat. The usage dependent system will pass gas flow; and therefore, allow water heating if the temperature of the water is sensed to be at or below the low limit established for the system, or if the flow sensor is detecting water flow. In this manner, during periods of non-use, the system temperature will be allowed to decay to the low limit temperature; and then the usage dependent system will allow the burner to cycle on and off to maintain the low limit. The low limit may be set in the range of 105 to 125 degrees, resulting in substantial energy savings over the normal system temperature of 145 degrees or more. According to an additional feature of the invention which has further advantages over the above described system, a interval timer is introduced in the flow detection system so that short duration draws of hot water detected by the flow sensor will not cause activation of a maximum temperature cycle, but draws which are associated with more substantial water requirements, such as the taking of a shower, will allow the system to reach its full thermostat upper set-point.

Only the coincidence of main thermostat heat demand and water flow will latch the usage dependent system on, permitting continuous gas flow under the control of the main system thermostat, until the main thermostat upper limit is reached; and then the system is reset to again be under the control of the usage dependent system.

According to the practice of the invention, a conventional hot water heater is manufactured as a usage dependent system by the addition of a minimum number of sensors and controllers, and with no disruption of the basic system function. By leaving the main system thermostat intact, it is possible to set the system temperature to a vacation setting without any interference from the usage dependent system. Such an installation also avoids any conflict with the industry certification standards, and history of experience with existing thermostats. At the same time, the system allows the full benefits of a usage dependent system to be obtained; and for the benefits obtainable only with a full integration into the system at the time of manufacture, including the location of the critical low limit temperature transducer, sensor, and the usage of an in-line flow sensor which also serves as an energy trap.

The positioning of the low limit sensor results in a responsive system that still avoids unnecessary cycling of the gas flow and burner operation. The positive indication of flow provided by the flow transducer provides a more precise initiation of an excursion to the maximum system temperature. The system thus achieves a major savings in energy with minimal inconvenience to the user.

Other advantages of the invention will become more apparent upon the reading of the following detailed description, together with the drawing, in which like reference numerals refer to like parts throughout, and in which:

DETAILED DESCRIPTION OF THE DRAWINGS

Figure 1:
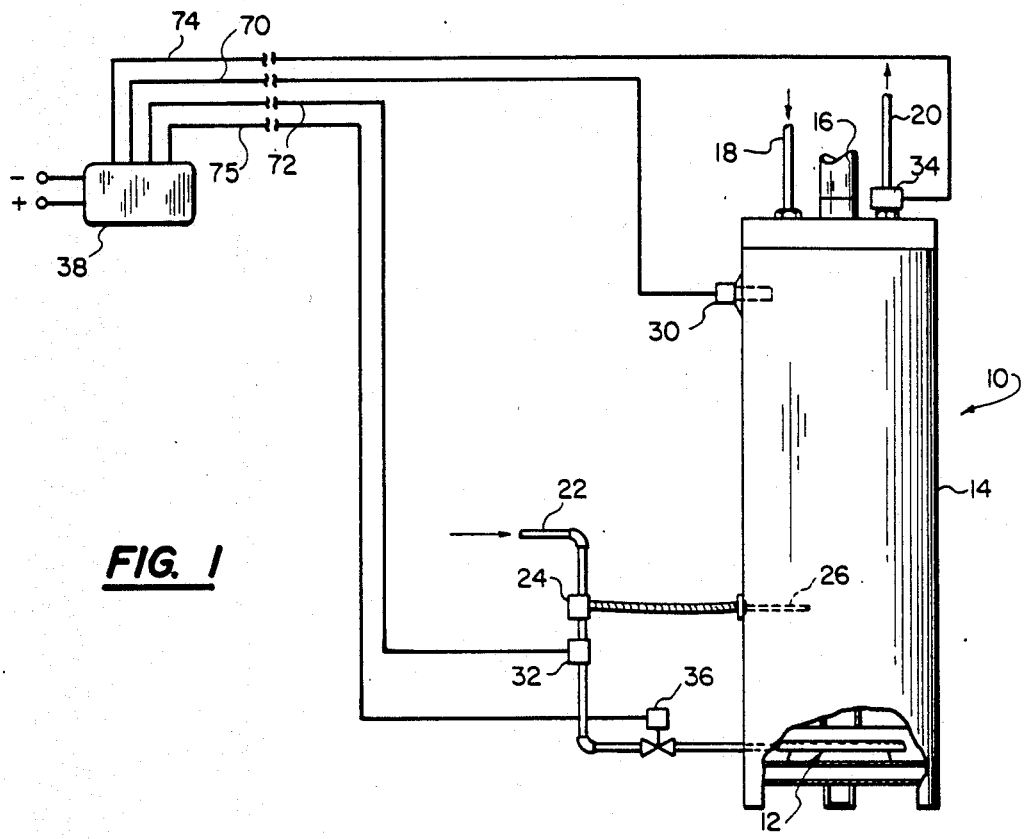
FIG. 1 is a partially diagrammatic front elevational view of a water heater showing the position of the sensors and controllers on the water heater tank and plumbing.

Referring now to the drawings, there is illustrated a gas water heater 10 incorporating a gas burner 12, and a tank structure 14 topped by a chimney vent 16, the water inlet pipe 18 and outlet pipe 20. Under normal operation, gas flows to the burner 12 through a gas pipe 22 under the control of the water heater thermostat controlled valve 24, as determined by the system temperature sensed by thermostat probe 26. The above recited elements all constitute components of a conventional gas water heater.

According to the practice of the invention, there are integrated into the manufacture of the gas water heater, additional transducers and controls including a low limit temperature transducer 30 which incorporates a temperature sensor and a temperature controlled switch for producing an output on line 70 when the temperature reaches the low temperature limit. This low temperature limit may be factory setable to account for geographic and other variations in the desired low temperature set point. the low temperature limit set point is setable in the range of 105 to 125 degrees. The low limit sensor 30 must be optimally placed within the tank. It has been found that the temperature sensor 30 must be placed along the height of the tank between 50 percent of the total tank height and 90 percent of the total tank height to avoid excessive cycling while maintaining sufficient sensitivity to the decay of mean tank temperature to maintain the low temperature limit at an adequate mean setting. Temperature sensor positions associated with prior art add-on systems are not adequate to achieve the maximum benefits of the present invention. Also integrated physically with the water heater package 10 is the pressure transducer 32. The pressure transducer detects gas pressure downstream of the thermostat controlled valve 24 (between the thermostat valve 24 and the burner 12). Output from the pressure transducer 32 on line 72 signals that the main system thermostat (not shown) is calling for heat because the main thermostat system control valve 24 has been opened admitting gas pressure to the transducer 32.

The flow transducer 34, while shown external to the tank 14, may also be located on a stub of the outlet pipe 20 within the tank. The flow transducer incorporates a switch which closes with the existence of a significant water flow rate on line 20 producing a signal on line 74.

The several signals are collected at the controller 40 which uses the presence or absence of the signals to determine when a control voltage should be placed upon line 75. The presence of a voltage on line 75 causes a solenoid controlled valve 36 to open so that if the main system thermostat controlled valve 24 is open, gas may flow through the pipe 22 to the burner 12 adding heat to the system; and therefore, increasing the temperature of the water.

Figure 2:
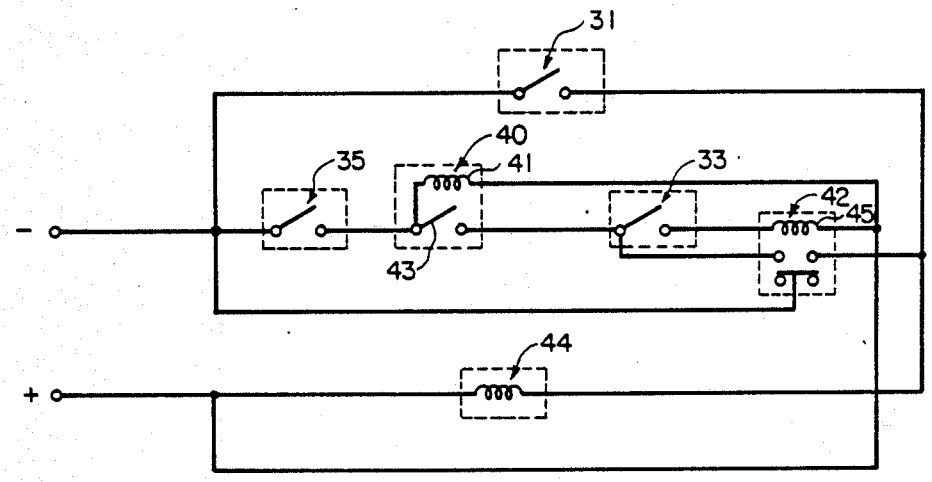
FIG. 2 is a schematic illustration of the electrical switch logic circuit.

Referring to FIG. 2, the switch 31 is a part of the temperature transducer 30 and closes when the temperature is below the low limit set point for transducer 30. Switch 33 is a part of the pressure transducer 32 and closes when transducer 32 detects the presence of gas pressure in pipe 22 beyond valve 24.

Switch 35 is physically associated and integrated with the flow transducer 34. When switch 35 is closed, it reflects a flow through the outlet pipe 20.

The remaining functions illustrated in FIG. 2 are physically located within the controller 38, and incorporate a time delay switch 40 with a heating coil 41 which causes switch 43 to close a predetermined interval after the application of power. Relay 42 closes only when current flows through the coil 45 after closure of the pressure switch 33, coinciding with timing out of the interval timer switch 40 but remains closed until the pressure switch 33 reopens (signaling the end of a heating cycle controlled by the main system thermostat). Power is delivered to the solenoid 44 by the completion of either the low temperature switch 31 or the flow dependent circuit of switches 35, 40, 33 and relay 42. The delivery of power to the solenoid coil 44 causes the solenoid control valve 36 to open permitting gas passed by the main system thermostat controlled valve 24 to reach the burner 12.

Figure 3:
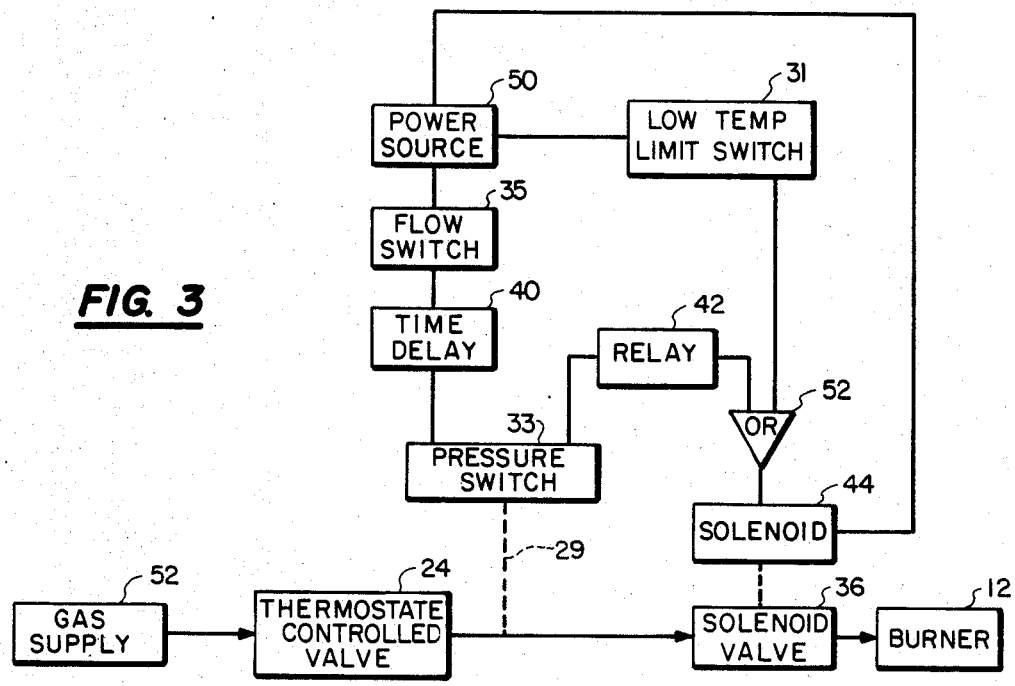
FIG. 3 is a system block diagram showing the logic relationship between the usage-dependent system and gas flow control.

Referring to FIG. 3, the functioning of the several elements in the integrated system is illustrated. The ga flow path is shown as proceeding from the gas supply 52, through the thermostat controlled valve 24 past the pressure sensor 32 (not illustrated), and through the solenoid controlled valve 36 to the burner 12. The sensing of the presence of a gas pressure passed by the thermostat controlled valve 24 is reflected by line 29 which causes the closure of pressure switch 33. However, even with the closure of pressure switch 33, power from the power source 50 will not reach the relay 42 without the coincidence of flow as reflected by the condition of flow switch 35, and the timing out of the time interval as reflected by the time delay switch 40. The low temperature switch 31 receives power directly from the power source, and the logic function OR 52, reflects the fact that presence of a signal from either the low temperature switch 31 or the relay 42 will activate the solenoid 44 and open the solenoid control valve 36.

Figure 4:
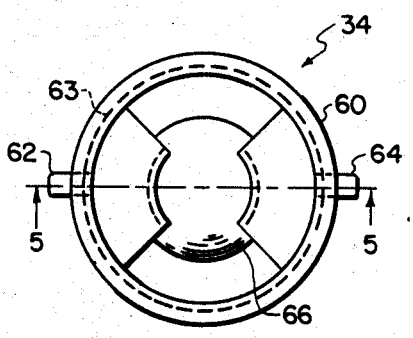
FIG. 4 is a plan view of the flow sensor and energy trap.
Figure 5:
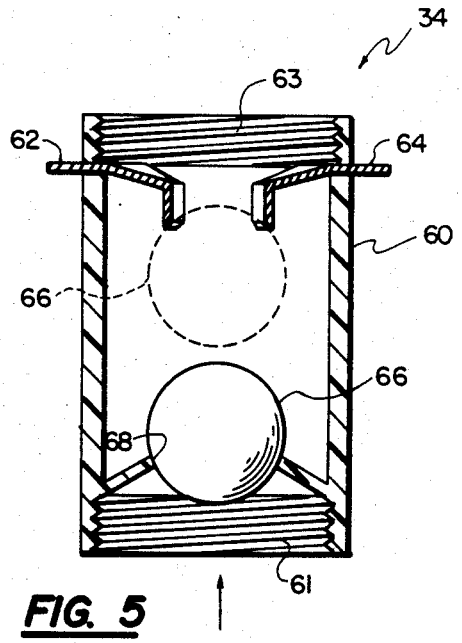
FIG. 5 is a sectional view taken on lines 5—5 of FIG. 4.

Referring to FIGS. 4 and 5, there is illustrated a flow transducer 34 which has particular advantages in connection with the invention. The flow transducer includes a body 60 with threaded ends 61 and 63 to be received on piping 20 (FIG. 1). As water flows out of the tank 14 in the direction of the arrow, a float ball 66 with a metallic coating is lifted by the water flow into registration with the switch contacts 62 and 64. When the ball reaches the dotted line position illustrated, electrical contact is made allowing a signal to flow on line 74 (FIG. 1), at the same time, water may pass around the switch contacts (see FIG. 4) unimpeded. When water flow ceases, the ball returns to the solid line position illustrated in a conical receptacle 68. Since the receptacle 68 is continuous around the inner diameter of the housing 60, then convective flow up into the outlet pipe 20, and direct heat conductive contact between the water and the tank, and the water in the outlet line, is avoided, creating a heat trap and reducing heat loss.

In use, the water heater thermostat will normally be set to produce an upper temperature limit of approximately 145 degrees or more, and the low temperature transducer 30 will have a factory set low temperature set point of 105 to 125 degrees. The low temperature limit provides adequate water for casual demands such as the amount of water associated with hand washing, but is sufficiently high that when substantial demands are made on the system, the burner 12 is normally able to keep up with the demand and raise the system temperature to the high limit thermostat set point. With a thermostat setting such as 145 degrees under normal circumstances, the low limit transducer functions to maintain tank temperature at the low limit set point because the main thermostat control valve is always open. Periodic cycling of the low temperature switch delivers power to the solenoid control valve 36 allowing gas flow to the burner 12. If substantial water demands are made on the system, such as associated with a shower or clothes washing, as detected by the coincidence of flow by the flow transducer 34 and the timing out of the time delay 40, then power is delivered to the relay 42 which in turn powers the solenoid 44 and solenoid controlled valve 36. Since the relay 42 remains latched until the pressure switch 33 opens, then the system will be allowed to reach the high limit under the control of the main system thermostat because the pressure sensor 32 will not detect the absence of pressure (and therefore open) until the main system thermostat shuts down at the high limit. Thus, if substantial water demands are made, then the system will cycle to the high limit (145 degrees or more). After reaching the high limit, the temperature will be allowed to decay until further substantial demands are made upon the system or the low limit is reached. When the main thermostat is turned to a setting below that of the low limit switch, such as 80 degrees, then the main system thermostat will not call for heat even at the low limit set point of the system, no gas will flow and there will be no heating of the water despite the opening of the solenoid control valve under the control of the low limit temperature transducer 30. With the system of the invention, during periods of non-use, such as overnight, the heat loss due to excessive temperature of the stored water will be avoided while maintaining an adequate supply of water for casual purposes. At the same time the system does not interfere with the other functions of the main thermostat, including vacation settings.

Having described our invention we now claim:

1. An integrated, usage-dependent temperature control for gas water heaters that incorporates a gas burner and wherein the water heater incorporates a main water temperature thermostat and a thermostat control valve. wherein the improvement comprises:

a low limit transducer means for sensing the temperature of water produced by a water heater relative to a low limit and producing a low limit signal when the temperature is below the low limit, flow transducer means for sensing water flow through said water heater and producing a water flow signal in response thereto, means for sensing when the main water temperature thermostat is calling for heat and producing a heat demand signal in response thereto, valve means downstream of the thermostat control valve means for controlling the flow of gas from the thermostat control valve to the burner, and a controller having an input means connected to receive said low limit signal said water flow signal and said heat demand signal for commanding said valve means to permit gas flow when the temperature sensed by said low limit transducer is below the set point of said main water temperature thermostat and below said low limit or when the temperature sensed is below the set point of said main water temperature thermostat and thereafter flow is sensed by said flow transducer means.

2. The system according to claim 1 wherein:

said means for sensing when the main thermostat is calling for heat comprises a pressure sensor in the gas line between the thermostat controlled valve and the gas burner.

3. The system according to claim 1 further including:

time delay means connected to said flow transducer for introducing an interval delay before a signal from said flow sensor can effect the position of said valve means.

4. The system according to claim 1 wherein:

said low limit transducer comprises a temperature sensor and switch, said temperature sensor is positioned on said water heater tank in heat conductive relationship with the water within said tank.

5. The system according to claim 4 wherein:

said low limit transducer is positioned on said tank at a point between 50 and 90 percent of the vertical height of said tank.

6. The system according to claim 1 wherein:

said flow transducer comprises a conductive element positioned for movement in water flowing through said water heater and a pair of switch elements positioned to intercept said conductive element upon the movement of said conduct element caused by water flow through said system.

7. The system according to claim 6 wherein:

said flow transducer further includes:

seat means for receiving said conductive element during periods of no-flow and for sealing the device from the admission of water to prevent direct conductive contact between the water on the upstream and downstream sides of said conductive element.

8. A method of controlling the temperature of water heaters incorporating a gas burner supplied from a gas line, comprising the steps of:

sensing water flow through said heater;

sensing the temperature of water within the water heater relative to a low limit and to the set point of the main water heater thermostat and opening a valve to permit the flow of gas to said gas burner when a temperature below said low limit and said set point of the water heater thermostat is reached or when a temperature below said set point is reached and thereafter the flow of water through said water heater is sensed.

9. The method of claim 8 wherein:

the sensing of the water flow is inhibited until a predetermined interval of time passes from the onset of flow and then determining if flow continues after the interval times out before permitting the flow of gas.

10. The method of claim 9 wherein:

the step of permitting the gas to flow is characterized by permitting the gas to flow until the temperature of the water reaches a high limit and then permitting the temperature to decay back down to the low limit.

* * * * *